US005123329A

United States Patent [19]

Irwin

[11] Patent Number: 5,123,329

[45] Date of Patent: Jun. 23, 1992

[54] SELF-ACTUATING BLOW FORWARD FIREARM

[76] Inventor: Robert M. Irwin, P.O. Box 26006, Las Vegas, Nev. 89126

[21] Appl. No.: 592,974

[22] Filed: Oct. 4, 1990

Related U.S. Application Data

[63] Continuation-in-part of Ser. No. 451,451, Dec. 15, 1989, abandoned.

[51] Int. Cl.[5] ..... F41A 5/20

[52] U.S. Cl. ..... 89/161; 89/14.3; 89/177; 89/191.02

[58] Field of Search ..... 42/10, 11; 89/33.03, 89/155, 156, 161

[56] References Cited

U.S. PATENT DOCUMENTS

| | | | |
|---|---|---|---|
| 726,399 | 4/1903 | Burgess | 89/161 |
| 1,429,370 | 9/1922 | Putnam | 89/161 |
| 1,834,021 | 12/1931 | Destree | 89/180 |
| 2,865,256 | 12/1958 | Marsh | 89/191 |
| 2,883,911 | 4/1959 | Musgrave | 89/161 |
| 3,261,264 | 7/1966 | Wilson | 89/193 |
| 3,736,839 | 6/1973 | Childers | 89/161 |
| 3,990,346 | 10/1976 | Irwin | 89/180 |
| 4,028,994 | 6/1977 | Ferluga | 42/10 |
| 4,061,075 | 12/1977 | Smith | 42/11 |

FOREIGN PATENT DOCUMENTS

| | | | |
|---|---|---|---|
| 131016 | 8/1919 | United Kingdom | 89/161 |
| 224927 | 11/1924 | United Kingdom | 89/161 |
| 756769 | 9/1956 | United Kingdom | 42/11 |

*Primary Examiner*—Stephen C. Bentley
*Attorney, Agent, or Firm*—Quirk, Tratos and Roethel

[57] ABSTRACT

The present invention comprises a self-actuating blow forward firearm having a fixed breech block located to the rear of the firearm. A cartridge feeder provides a supply of cartridges to the loading area so that the firearm can be used as an automatic or semi-automatic weapon. The firearm also contains an outer receiver tube and a movable inner gun barrel which is biased toward the rear of the firearm by a spring disposed in a chamber between the receiver tube and the inner movable barrel. When the trigger mechanism is activated, the action of the bias spring causes the inner movable barrel to move backward toward the breech block stripping a cartridge from the feeding device and forcing the end of the cartridge against the firing pin on the breech block. The bullet is fired down the bore of the inner movable barrel. The movement of the bullet along the bore of the inner movable barrel drags the barrel forward against the action of the bias spring. The addition of a piston device attached to the muzzle end of the inner movable barrel causes added momentum to be delivered to the moving barrel to assist the barrel in its forward movement. This added momentum can be further enhanced by including a muzzle brake adjacent the piston device. The battering of the various parts of the firearm and the cycle speed of the firearm can be reduced by use of an air pressure chamber situated between the inner movable barrel, the receiver tube, the barrel guide and a shoulder on the inner movable barrel.

11 Claims, 3 Drawing Sheets

SELF-ACTUATING BLOW FORWARD FIREARM

CROSS-REFERENCE TO RELATED APPLICATION

This application is a continuation-in-part of application Ser. No. 07/451,451, filed Dec. 15, 1989, now abandoned, and entitled Self-Actuating Blow Forward Firearm.

BACKGROUND OF THE INVENTION

This invention relates to a self-actuating blow forward firearm, and more particularly to a self-actuating blow forward firearm designed for use as an automatic or semi-automatic weapon and having a fixed breech block and a moving barrel.

In a self-actuating firearm, the combustion or explosion of the propellant from a round of ammunition is used to perform one or more of the functions of the operating cycle of the firearm. Typically, the gas from the combustion or explosion is used to propel the bullet down the barrel of the firearm and is also used to activate the firing cycle for the next round of ammunition. A more complete explanation of self-actuating firearms is contained in U.S. Pat. No. 2,865,256 (Marsh), which is incorporated herein by this reference.

Previously in self-loading automatic or semi-automatic firearms, it has been necessary to use a mechanically locked breech system to prevent the breech block from moving backward upon firing of the firearm. Any backward movement of the breech block will inhibit the forward movement of the bullet out of the barrel of the firearm. These mechanically locked breech block designs suffer from the drawback of high manufacturing costs and the necessity for periodic replacement of mechanical parts during periods of extended use.

Instead of mechanically locking the breech block, it has been previously proposed to use what is known as a "blowback" type design which generally utilizes a very heavy breech block to allow sufficient delay in the rearward movement of the breech block to prevent the premature opening of the rear portion of the firing chamber during the high pressure portion of the firing cycle. Such a design is likewise used to encourage the forward movement of the bullet down the barrel of the firearm due to the effect of the natural expansion of the exploding gases caused by the firing of the firearm. Typical of such a heavy unlocked breech block design is the Thompson submachine gun or the Israeli Uzi submachine gun.

These designs using a heavy breech block suffer from the drawback of excessive weight which limits their effectiveness for military applications as well as the drawback that the heavy breech block moving inside the weapon receiver limits the ability of the firearm to be used as a high speed automatic weapon due to the excessive vibration.

It is an object of the present invention to provide a self-actuating blow forward firearm which has the ability to be used as a high speed automatic weapon and also is relatively lightweight in design and inexpensive to manufacture.

It is a feature of the present invention to provide a self-actuating blow forward firearm with a fixed breech block coupled with a moving barrel, the movement of the barrel resulting from the drag of the bullet along the interior of the barrel toward the muzzle of the firearm and from the use of a gas piston attached to the barrel, and is further enhanced by the addition of a muzzle brake.

It is an advantage of the present invention that an automatic or semi-automatic self-actuating blow forward firearm is provided which is both lightweight and inexpensive to manufacture, which eliminates the need for a mechanically locked breech block or a heavy unlocked breech block and which is extremely compact because the receiver length necessary for the movement of the breech block is eliminated.

SUMMARY OF THE INVENTION

The present invention comprises a self-actuating blow forward firearm having a fixed or stationary breech block located to the rear of the firearm. Just in front of the breech block, a cartridge feeder provides a supply of cartridges to the loading area so that the firearm can be used as an automatic or semi-automatic weapon. The firearm also contains an outer receiver tube and a movable inner gun barrel which is biased toward the rear of the firearm by a spring disposed in a chamber between the receiver tube and the inner movable barrel. Alternatively, the bias spring may be mounted along side and parallel to the barrel; this alternative spring mounting will reduce heat fatigue on the bias spring.

When the trigger mechanism is activated, the action of the bias spring causes the inner movable barrel to move backward toward the breech block. The backward movement strips a cartridge from the cartridge feeding device and forces the end of the cartridge against the firing pin on the breech block. The firing pin causes the bullet to be fired down the bore of the inner movable barrel. Such a firearm may begin its firing cycle from either an "open breech" or a "closed breech" position with various trigger mechanisms as will be appreciated by those skilled in the art.

The movement of the bullet along the bore of the inner movable barrel drags the barrel forward against the action of the bias spring. This effect is particularly pronounced if low speed ammunition, i.e. generally under 1000 feet per second muzzle velocity, is used.

The present invention allows the use of high speed ammunition, i.e. generally 1000 feet per second or higher muzzle velocity, due to the addition of a piston device attached to the inner movable barrel. The piston device causes added momentum to be delivered to the moving barrel to assist the barrel in its forward movement. This added momentum can be further enhanced by including a muzzle brake adjacent the piston device.

Unless the firing action is interrupted by the action of the trigger, the barrel will continue to cycle backward and forward to effect an automatic firing action until the supply of cartridges is exhausted.

DETAILED DESCRIPTION OF THE PREFERRED EMBODIMENTS

Figure 1:
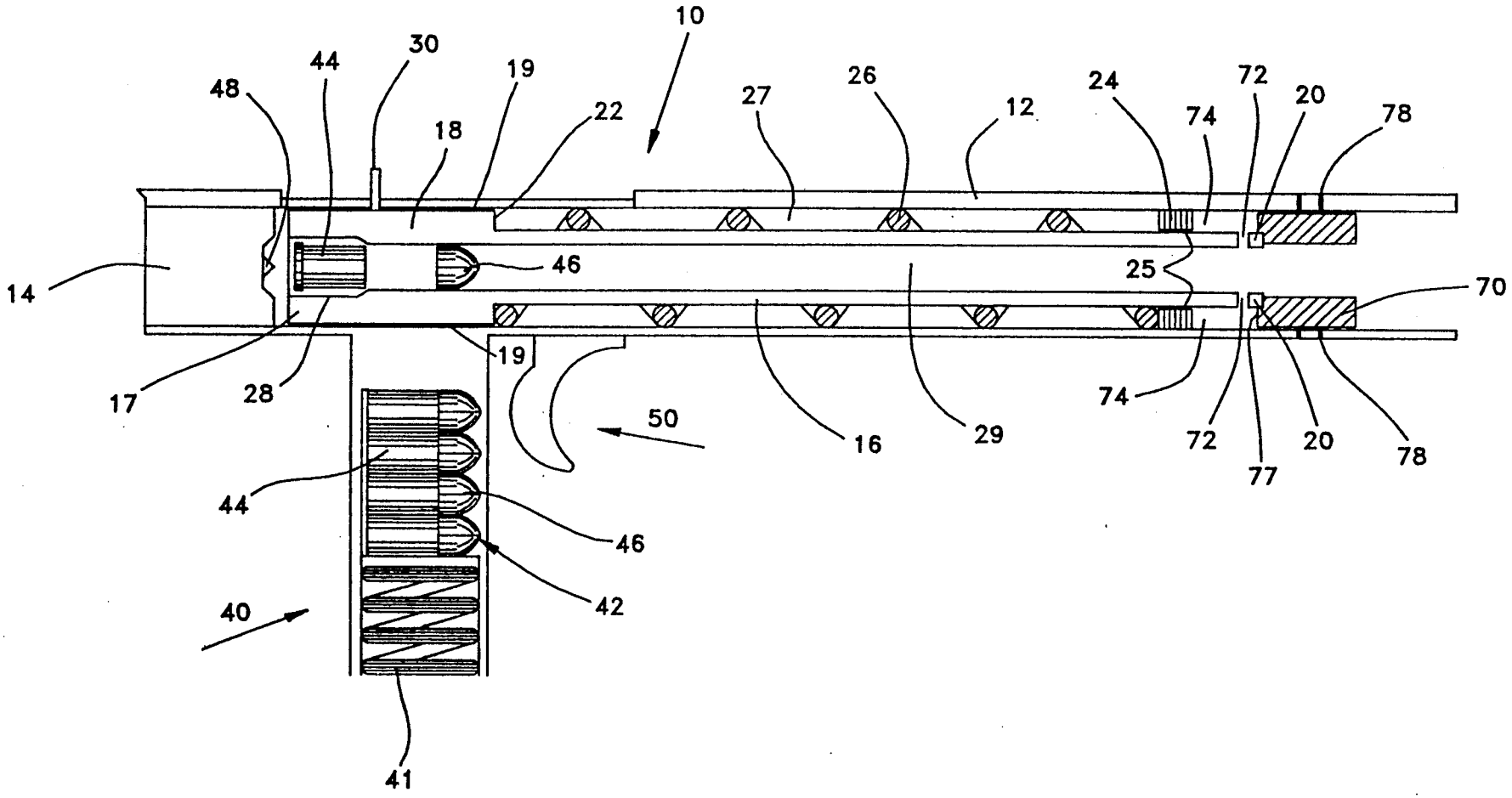
FIG. 1 shows a side sectional view of the firearm of the present invention with the parts of the firearm shown in their positions at the approximate instant that the cartridge is fired.

The firearm of the present invention is shown generally at 10 in FIG. 1. The firearm 10 has a receiver tube 12 of a generally circular cross section. The receiver tube 12 contains the inner movable barrel 16 also of generally circular cross section. The length of the receiver tube 12 is selected so that the receiver tube 12 extends beyond the end of the inner movable barrel 16 at least the length of a cartridge 42 for the reasons that will be more fully explained herein.

The inner movable barrel 16 includes an enlarged rear barrel portion 18 of generally circular configuration so that the rear barrel portion 18 slidably engages the inner wall of the receiver tube 12. There is a slight gap 19 around the circumference of the rear barrel portion 18 and the inside of the receiver tube 12 in order to permit this relative sliding movement along the inside of the receiver tube 12. The inner movable barrel 16 also includes a forward barrel end 20.

A bias spring 26 surrounds the inner movable barrel 16 and is contained within a chamber 27. One end of the bias spring 26 abuts against the barrel shoulder 22 on the enlarged rear barrel portion 18. The other end of the bias spring is held in place by an inner barrel guide 24 mounted at the forward end, and on the inside of, the receiver tube 12. The force of the bias spring 26 acting on the barrel shoulder 22 biases the inner movable barrel 16 toward the rear of the receiver tube 12. There is another slight gap 25 around the circumference of the inner movable barrel 16 at the point that it slides past the inside of the inner barrel guide 24 in order to permit this relative sliding movement along the inside of the inner movable barrel 16.

A breech block 14 is mounted approximate the rearward end of the receiver tube 12, either inside or at the rear end of the receiver tube 12. The breech block 14 has a conventional firing pin 48 mounted on its interior surface at approximately the center portion thereof. Adjoining the location of the firing pin 48, a cartridge chamber 28 is provided in the rear barrel portion 18. The cartridge chamber 28 is in axial alignment with the bore 29 in the inner movable barrel 16.

A conventional cartridge feeding mechanism 40 is attached to the receiver tube 12 and is spring loaded with cartridges 42. Each cartridge 42 has two parts—the cartridge shell 44 and the bullet 46. Also included is a conventional trigger mechanism 50 as part of the firearm 10. The firearm of the present invention is also provided with a conventional cartridge shell ejection mechanism (not shown) to remove the spent cartridge shells 44 after firing.

At the upper side of the rear barrel portion 18 there is provided a conventional cocking handle 30 which rides in a slot provided in the receiver tube 12. The cocking handle 30 allows the firearm 10 to be cocked so that firing can begin when the trigger mechanism 50 is actuated.

A piston 70 in the shape of a tubular ring is fastened by threads or other suitable means to the forward barrel end 20 of the inner movable barrel 16. The outside surface of the piston 70 slidably engages the inner wall of the receiver tube 12. A plurality of first exhaust openings 72 are provided in the inner movable barrel 16 behind the point at which the piston 70 is fastened to the forward end 20 of the inner movable barrel 16. These first exhaust openings 72 can be in the form of circular openings or other configured slots in either a regular or irregular pattern about the circumference of the inner barrel 16.

The first exhaust openings 72 act as ports to feed pressurized exhaust gases from the exploding powder contained in the interior of the inner movable barrel 16 into the space 74 between the piston 70 and the inner barrel guide 24. The gas pressure exhausting through the first exhaust openings 72 causes the piston 70 to move forward and pull the inner movable barrel 16 along with it.

In an alternative embodiment of the present invention, a plurality of second exhaust openings 78 may be provided in the receiver tube 12 toward the forward end thereof. These second exhaust openings 78 can be in the form of circular openings or other configured slots in either a regular or irregular pattern about the circumference of the receiver tube 12.

In operation, the parts of the firearm 10 shown in FIG. 1 are in the positions they would be in at the point in time immediately after the cartridge 42 has been ignited by the firing pin 48 and the powder contained in the cartridge shell 44 behind the bullet 46 has exploded. The bullet 46 of the cartridge has begun to move down the bore 29 of the inner movable barrel 16 due to the force of the gases from the exploding powder in the cartridge 42. The friction between the exterior surface of the bullet 46 and the interior surface of the inner movable barrel 16 causes the inner movable barrel 16 to slide forward in relationship to the receiver tube 12. The movement of the inner barrel 16 is more pronounced if low speed ammunition is used. The term "low speed ammunition" is intended to cover ammunition having generally a muzzle velocity less than 1000 feet per second.

The inner barrel guide 24 guides the forward movement of the inner movable barrel 16. The inner movable barrel 16 will continue to move forward until the force from the compression of the bias spring 26 overcomes the frictional force caused by the bullet 42 moving down the interior surface of the inner movable barrel 16.

The strength and solid height of the bias spring 26 is selected to allow the inner movable barrel 16 to travel forwardly at least far enough so that the rear end 17 of rear barrel portion 18 has cleared the cartridge feeding mechanism 40. When that has happened, the next cartridge 42 in line will be forced upwardly by the spring 41 into alignment with the cartridge chamber 28.

Figure 2:
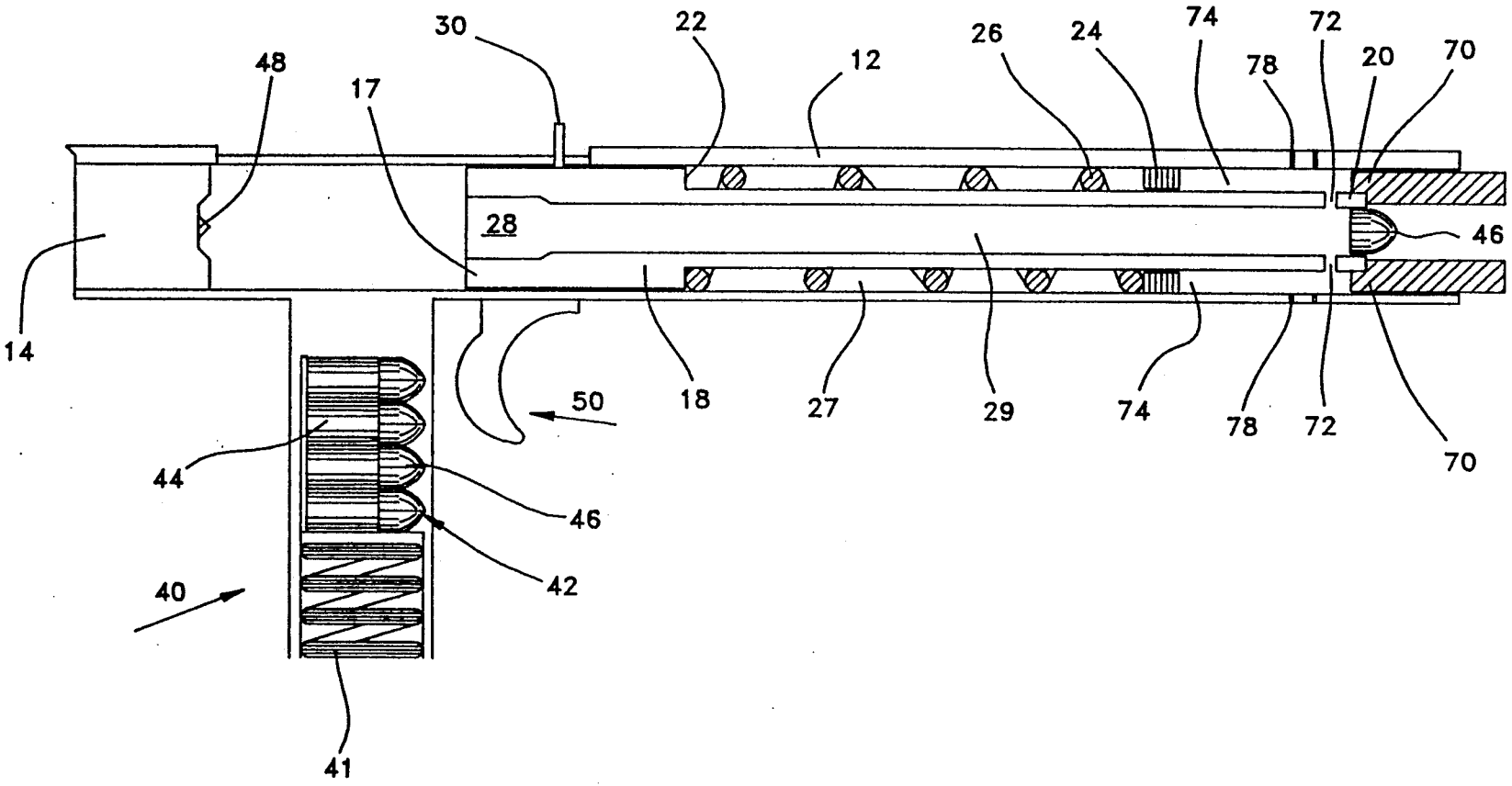
FIG. 2 shows a side sectional view of the firearm of the present invention with the parts of the firearm shown in their positions at the approximate instant that the bullet passes the exhaust openings and the gas piston is activated.

FIG. 2 shows the position of the parts of the firearm 10 at the point in time that the bullet 46 has just passed the exhaust openings 72 adjacent the end 20 the inner movable barrel 16 and just before the bullet 46 exits the end 20 of the inner movable barrel 16. When the bullet 46 reaches this position, the exhaust gases in the bore 29 of the inner movable barrel 16 exit into the chamber 74 surrounding the inner movable barrel 16. The pressure of the exhaust gases in chamber 74 is exerted on piston 70 which further forces the inner movable barrel 16 forward at high speed.

The inner movable barrel 16 must move forward at least one cartridge length so that the rear barrel portion 18 clears beyond the next cartridge 42 in line in the cartridge feeding mechanism 40. If the inner movable barrel 16 and the rear barrel portion 18 do not move forward far enough, the next cartridge 42 in line will not have room to feed into firing position.

Once the bullet has left the inner movable barrel 16, the frictional forces of the bullet 46 on the interior of the inner movable barrel 16 causing the forward movement of the inner movable barrel 16 will no longer be present. Likewise, the exhaust gases in chamber 74 will also be exhausted back through the exhaust openings 72 and out through the muzzle end of the inner movable barrel and into the outside air if the inner movable barrel 16 has moved forward far enough for the piston 70 to clear the end of the receiver tube 12.

The use of the additional second exhaust openings 78 in the receiver tube 12 will also enhance the emission of the exhaust gases out of the firearm 10. These second exhaust openings are located close enough to the forward end of the receiver tube 12 that they will still be covered up by the piston 70 when the exhaust gases first act upon the piston 70 to give the inner movable barrel 16 its forward thrust.

The force of the bias spring 26 will then cause the inner movable barrel 16 to be pushed backward inside and relative to the receiver tube 12 The next cartridge 42 in the firing chamber will be picked up by the moving cartridge chamber 28 and forced against the firing pin 48 causing the powder in the cartridge 42 to explode and starting the process over again. The process will keep cycling until all the cartridges 42 in the cartridge feeding mechanism 40 have been exhausted. The typical cycling time from firing to firing is approximately 1/10th of a second.

Another important feature of the structure of the firearm of the present invention is that the movement of the inner movable barrel 16 is affected by the air pressure in chamber 27. When the firearm 10 is in the position shown in FIG. 1, the chamber 27 containing the bias spring 26 is open to the outside air by means of the slot in the top of the receiver tube 12 in which the cocking handle 30 rides. However, when the firearm 10 is in the position shown in FIG. 2, the chamber 27 containing the bias spring 26 is sealed from the outside air because the rear barrel portion 18 has moved forward beyond the end of the slot in which the cocking handle 30 rides. Thus chamber 27 is closed by the combination of the rear barrel portion 18, the inner barrel guide 24, the inner movable barrel 16 and the inner wall of the receiver tube 12. The air trapped in the closed chamber 27 becomes compressed as the inner movable barrel 16 and the rear barrel portion 18 move forward. This compression of the air in chamber 27 slows down the forward movement of the inner movable barrel 16. When the inner movable barrel 16 reaches the end of its forward stroke, the air compressed in the chamber 27 will bleed out of the chamber 27 through the slight gaps 19 and 25.

When the bias spring effects the return stroke of the inner movable barrel 16, this return stroke is retarded or dampened because it is acting inside a chamber 27 that is now under less than atmospheric pressure. The beginning of the return stroke of the inner movable barrel 16 enlarges the size of the chamber 27 and the outside air is slow to flow into this chamber because of the small size of the slight gaps 19 and 25. This partial vacuum in chamber 27 slows down the initial return of the inner movable barrel 16 back toward the breech block 14.

This inhibition of the return of the inner movable barrel only occurs at the beginning of the return stroke. Once the rear barrel portion 18 moves backward enough so that the chamber 27 again comes into communication with the slot in which the cocking handle 30 rides, the air pressure in chamber 27 will return to atmospheric pressure. This allows the rear barrel portion 18 to gather speed as it moves backward so that the next cartridge 42 will be forced against the firing pin 48 to fire the next cartridge so that the cycle can repeat.

This air buffer created in chamber 27 is most advantageous in the firearm of the present invention in that it slows down the cycle rate of the firearm 10 which reduces the battering of the bias spring 26, the inner movable barrel 16 and the receiver tube 12 and adds to the controllability of the firearm 10.

Figure 3:
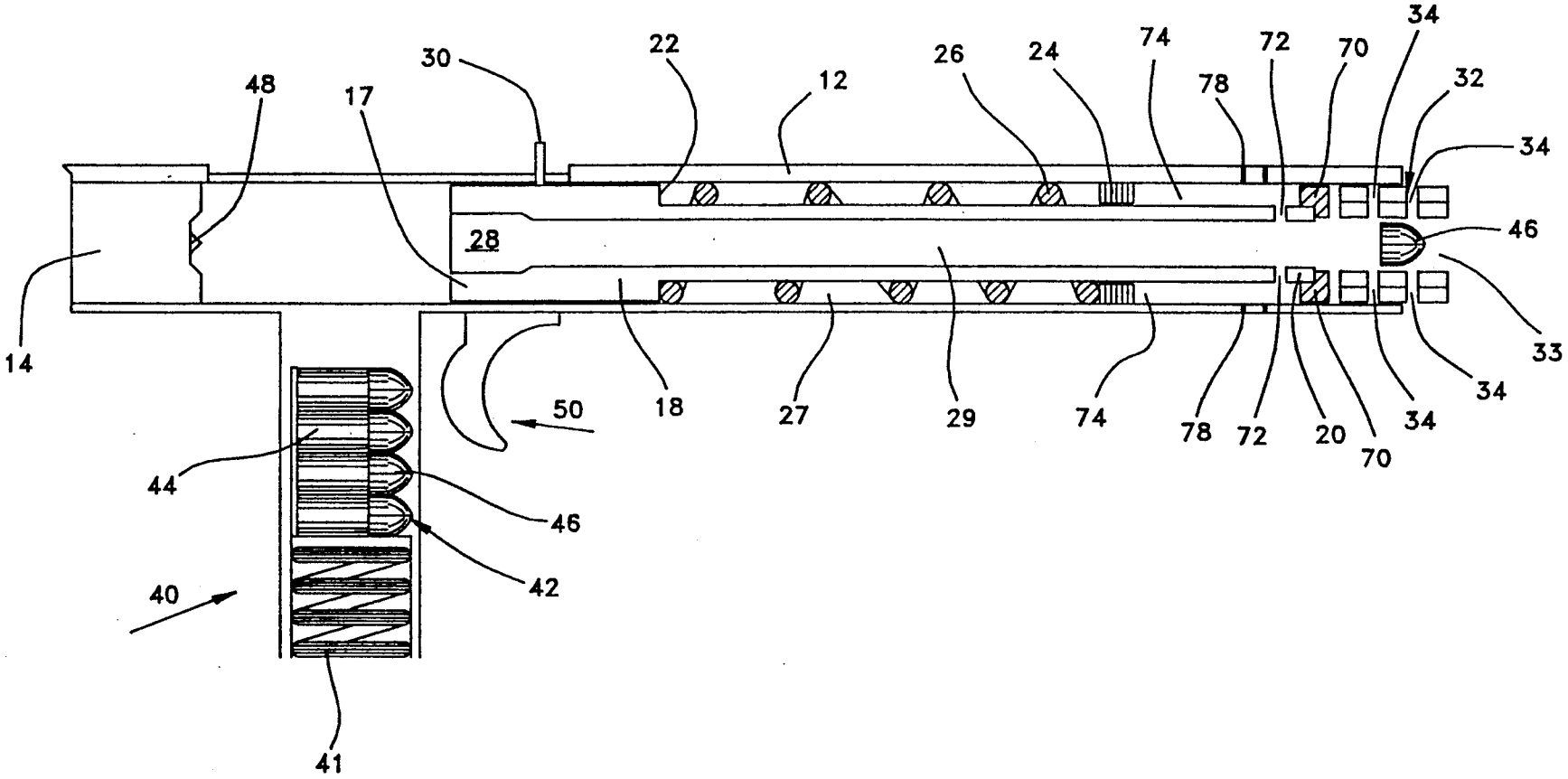
FIG. 3 shows a side sectional view of an alternate embodiment of the firearm of the present invention.

In the embodiment shown in FIG. 3, at the forward barrel end 20 of the movable barrel 16 there is provided a muzzle brake 32 attached to the piston 70. The muzzle brake 32 is a tubular member of generally circular cross section with a longitudinal axial opening 33 through the center thereof slightly larger than the bore 29 in the movable barrel 16. The muzzle brake 32 can be connected to the piston 70 by any suitable means such as welding if permanent attachment is desired, or by screw threads if replaceable attachment is desired.

The muzzle brake 32 has a plurality of muzzle apertures 34 located about the circumference of the muzzle brake 32 and communicating with the axial opening 33. The muzzle apertures 34 can be in the form of circular openings or other configured slots in either a regular or irregular pattern about the circumference of the muzzle brake 32. The muzzle apertures 34 provide a passageway for the exhaust gas to exit the bore 29 and the axial opening 33 as will be explained below.

The muzzle brake 32 also assists in the movement of the inner barrel 16 relative to the receiver tube 12. Depending on the type of cartridges that are used in the firearm 10, there may not be enough frictional force imparted to the inner surface of the inner movable barrel 16 by the bullet 46 to pull the inner movable barrel 16 forward. This has been noticed when high speed ammunition is used. The term "high speed ammunition" is intended to cover ammunition having generally a muzzle velocity of 1000 or more feet per second.

As the bullet 46 approaches the end of the bore 29 in the inner movable barrel 16, the expanding gas from the explosion still remains behind the bullet 46 and is acting on the base of the bullet 46. As the bullet 46 enters the axial opening 33 of the muzzle brake 32, the gas behind the bullet 46 will exhaust out of the muzzle apertures 34 in the circumference of the muzzle brake 32. This gas exhaustion out of the muzzle brake 34 causes the inner movable barrel 16 to be pulled forward.

Without being bound to any particular theory of the invention, it appears that there is enough lateral force exerted on the sides of the muzzle apertures 34 by the exploding gas exhausting through the muzzle apertures 34 to impart a forward motion to the muzzle brake 32 which in turn causes the inner movable barrel 16 to also move forward since it is attached to the muzzle brake 32. Once the exploding gas has been exhausted out of the bore 29 and the axial opening 33 of the muzzle brake 32 and the bullet 46 has exited the firearm 10, the force of the bias spring 26 will cause the inner movable barrel 16 to begin moving in the opposite direction back into the receiver tube 12.

The length of the receiver tube 12 is selected so that the receiver tube 12 extends beyond the end of the inner movable barrel 16 at least the length of a cartridge 42. This distance provides sufficient length for the receiver tube 12 so that the exhaust gases acting on the piston 70 can drive the inner movable barrel 16 forward far enough so that the rear end 17 of the rear barrel portion 18 can clear forward far enough to allow the cartridge feeder 40 to feed the next cartridge 42. The location of the optional second exhaust openings 78 is also selected so that the exhaust gases act upon the piston 70 for sufficient time to push the piston 70 forward which in turn pulls the inner movable barrel 16 forward.

While the invention has been illustrated With respect to several specific embodiments thereof, these embodiments should be considered as illustrative rather than limiting. Various modifications and additions may be made and will be apparent to those skilled in the art. For example, the invention has been described in connection with a submachine gun, but the invention can also be used with pistols, machine guns, rifles, cannons and shotguns. Accordingly, the invention should not be limited by the foregoing description, but rather should be defined only by the following claims.

What is claimed is:

1. A self-actuating blow forward firearm comprising:

a) a receiver tube having a forward end and a rearward end, b) a breech block fixedly mounted approximate the rearward end of the receiver tube, the breech block including a firing pin mounted thereon, c) an inner movable barrel mounted within the receiver tube and having a cartridge chamber and a bore therein, the inner movable barrel further including a rear barrel portion slidably engaging an inner surface of the receiver tube, d) an inner barrel guide mounted between the receiver tube and the inner movable barrel, e) a bias spring mounted within a first chamber formed by the receiver tube, the inner movable barrel, the rear barrel portion and the inner barrel guide, a first end of the bias spring being disposed against the rear barrel portion and a second end of the bias spring being disposed against the inner barrel guide, f) a piston attached to the forward end of the inner movable barrel, g) a second chamber formed by the inner barrel guide, the receiver tube, the piston and the inner movable barrel, h) at least one first exhaust opening provided in the forward end of the inner movable barrel so that the bore of the inner movable barrel is in communication with the second chamber, i) a cocking handle attached to the rear barrel portion and a slot in the receiver tube in which the cocking handle rides during movement of the inner movable barrel, and j) a muzzle brake attached to the forward end of the inner movable barrel, mounted on the interior of receiver tube and aligned with the bore thereof whereby the inner movable barrel is pulled forward through the receiver tube by the action of a bullet traveling down the bore of the inner movable barrel and by the action of exhaust gases acting upon the piston and the inner movable barrel being pushed rearward through the receiver tube by action of the bias spring so that the firearm is capable of firing a plurality of cartridges automatically.

2. The firearm as described in claim 1 wherein a plurality of first exhaust openings are provided around the circumference of the inner movable barrel.

3. The firearm as described in claim 1 wherein at least one second exhaust opening is provided in the receiver tube.

4. The firearm as described in claim 3 wherein a plurality of second exhaust openings are provided around the circumference of the receiver tube.

5. The firearm as described in claim 1 wherein the muzzle brake includes at least one lateral aperture in a wall thereof so that exhaust gases may move through the muzzle brake to assist the forward movement of the inner movable barrel.

6. The firearm as described in claim 5 wherein the muzzle brake includes a plurality of lateral apertures around the circumference of the wall of the muzzle brake.

7. A self-actuating blow forward firearm comprising:

a) a receiver tube having a forward end and a rearward end, b) a breech block fixedly mounted approximate the rearward end of the receiver tube, the breech block including a firing pin mounted thereon, c) an inner movable barrel mounted within the receiver tube and having a cartridge chamber and a bore therein, the inner movable barrel further including a rear barrel portion slidably engaging an inner surface of the receiver tube, d) an inner barrel guide mounted between the receiver tube and the inner movable barrel, e) a first chamber formed by the receiver tube, the inner movable barrel, the rear barrel portion and the inner barrel guide, f) means within the first chamber for biasing the inner movable barrel toward the rearward end of the receiver tube, g) a second chamber formed by the inner barrel guide, the receiver tube, the piston and the inner movable barrel, h) means within the second chamber for pulling the inner movable barrel toward the forward end of the receiver tube, i) means for dampening forward movement of the inner movable barrel by momentarily sealing air within the first chamber during the final portion of the forward movement of the inner movable barrel, and j) means for retarding rearward movement of the inner movable barrel by momentarily sealing air within the first chamber creating a partial vacuum during the initial portion of the rearward movement of the inner movable barrel wherein the action of the firearm being fired activates the forward and rearward movement of the inner movable barrel so that the firearm is capable of firing a plurality of cartridges automatically.

8. The firearm as described in claim 7 wherein the means for biasing the inner movable barrel toward the rearward end of the receiver tube include a bias spring mounted within the first chamber.

9. The firearm as described in claim 7 wherein a first end of the bias spring is disposed against the rear barrel portion and a second end of the bias spring is disposed against the inner barrel guide.

10. The firearm as described in claim 7 wherein the means for pulling the inner barrel toward the forward end of the receiver tube includes a piston attached to the forward end of the inner movable barrel, and at least one aperture provided in the forward end of the inner movable barrel so that the bore of the inner movable barrel is in communication with the second chamber.

11. The firearm as described in claim 10 wherein the means for pulling the inner barrel toward the forward end of the receiver tube further includes a muzzle brake having at least one muzzle aperture therein so that exhaust gases from the inner barrel are diverted in such a manner as to increase the forward movement of the inner barrel.

* * * * *